US008610752B2

(12) United States Patent
Tsugaru

(10) Patent No.: US 8,610,752 B2
(45) Date of Patent: Dec. 17, 2013

(54) THERMAL PRINTER

(75) Inventor: Hiroyuki Tsugaru, Tokorozawa (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 37 days.

(21) Appl. No.: 13/398,006

(22) Filed: Feb. 16, 2012

(65) Prior Publication Data

US 2012/0212562 A1 Aug. 23, 2012

(30) Foreign Application Priority Data

Feb. 18, 2011 (JP) ..... 2011-032776

(51) Int. Cl.
*B41J 2/32* (2006.01)

(52) U.S. Cl.
USPC ..... 347/222

(58) Field of Classification Search
USPC ..... 347/171, 222
See application file for complete search history.

(56) References Cited

U.S. PATENT DOCUMENTS

2011/0193926 A1* 8/2011 Matsushima et al. ..... 347/197

FOREIGN PATENT DOCUMENTS

| | | |
|---|---|---|
| JP | 3-155965 | 7/1991 |
| JP | 5-229223 | 9/1993 |
| JP | 2009-286002 | 12/2009 |

* cited by examiner

*Primary Examiner* — Huan Tran
(74) *Attorney, Agent, or Firm* — Wenderoth, Lind & Ponack, L.L.P.

(57) ABSTRACT

A thermal printer includes a head cover configured to be movable from a secured position which is secured to cover at least a part of a thermal head in a direction away from the thermal head in a state in which at least a part of the head cover is supported by a printer main body.

13 Claims, 5 Drawing Sheets

THERMAL PRINTER

PRIORITY CLAIM

The present application is based on and claims priority from Japanese Patent Application No. 2011-32776, filed on Feb. 18, 2011, the disclosure of which is hereby incorporated by reference in its entirety.

BACKGROUND

1. Technical Field

The present invention relates to a thermal printer, and more specifically, to an improvement in a head cover which protects a thermal head.

2. Description of the Related Art

A thermal printer includes a cover (head cover) which covers a part of a thermal head for the purpose of preventing the wear of the thermal head due to contact with paper. In general, this type of head cover is attached so that it is easily separable from a printer main body (including a cover of a printer) in order to make replacement of the thermal head more convenient.

Japanese Patent Application Publication No. H03-155965 describes a head cover including a sensor which detects a standard position of paper such as a leading end.

However, if the head cover becomes completely separated from the printer main body, misattachment thereof to the printer main body may not be noticed or the head cover may be lost after replacing the thermal head.

Regarding the head cover including a paper detection sensor, even in a state in which the head cover is removed from the printer main body, wires (lead wires) for sending electric signals to a controller or the like from the paper detection sensor are connected to the controller or the like disposed in the printer main body. Accordingly, the potential to misattach the head cover, or the potential to lose the head cover may be decreased. However, it is necessary to pay special attention to the wiring of the lead wires, so that the lead wires of the paper detection sensor are not held between the printer main body and the head cover, or are not excessively pulled when attaching the head cover.

SUMMARY

The present invention has been made in view of the above circumstances, and an object of the present invention is to provide a thermal printer having fewer problems in terms of a head cover when replacing a thermal head.

In order to achieve the above object, one embodiment of the present invention provides a thermal printer including a head cover configured to be movable from a secured position which is secured to cover at least a part of a thermal head in a direction away from the thermal head in a state in which at least a part of the head cover is supported by a printer main body.

BRIEF DESCRIPTION OF THE DRAWINGS

The accompanying drawings are included to provide further understanding of the invention, and are incorporated in and constitute a part of this specification. The drawings illustrate an embodiment of the invention and, together with the specification, serve to explain the principle of the invention.

DETAILED DESCRIPTION OF THE PREFERRED EMBODIMENT

Hereinafter, a specific embodiment of a printer and a paper detector provided in the printer will be described with reference to the drawings.

Figure 1:
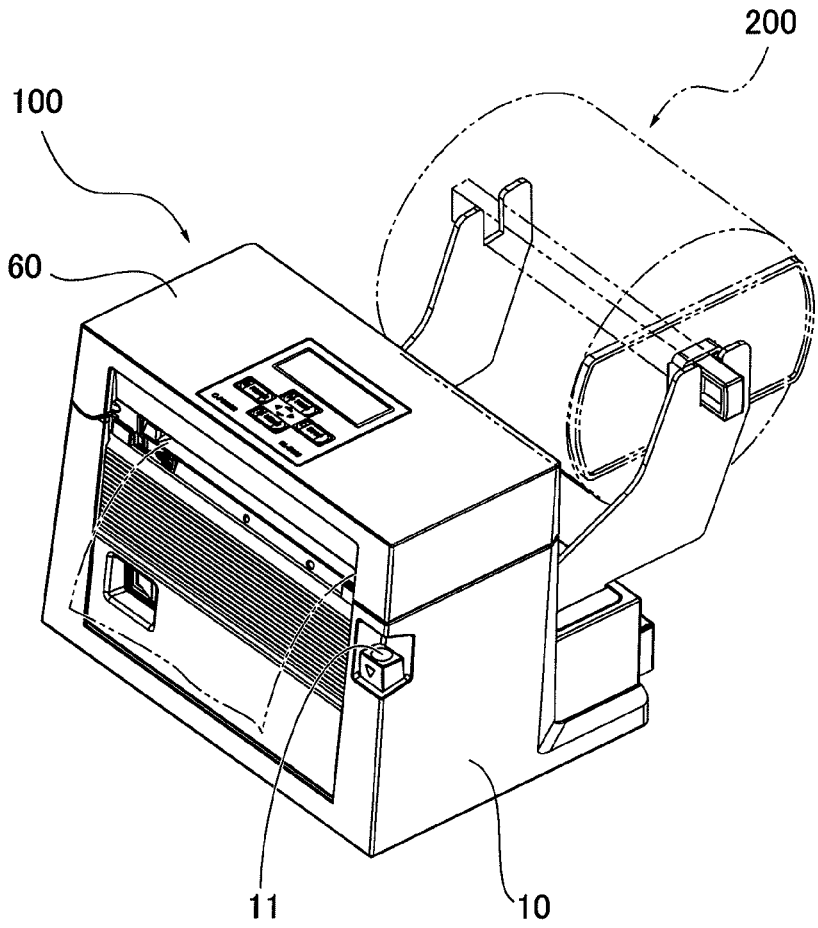
FIG. 1 is a perspective view illustrating one embodiment of a thermal printer according to the present invention.

FIG. 1 is a perspective view illustrating a thermal printer 100 as one embodiment of a thermal printer of the present invention. The thermal printer 100 includes a main body 10 and a cover 60.

The cover 60 is rotatably supported by the main body 10. The cover 60 is locked in a general usage state to the main body 10 by a (not shown) lock mechanism connected to an opening-closing button 11 provided in the main body 10. Upon pressing the opening-closing button 11, the lock mechanism interlocks with the opening-closing button 11, so that the cover 60 is unlocked from the main body 10.

Figure 2:
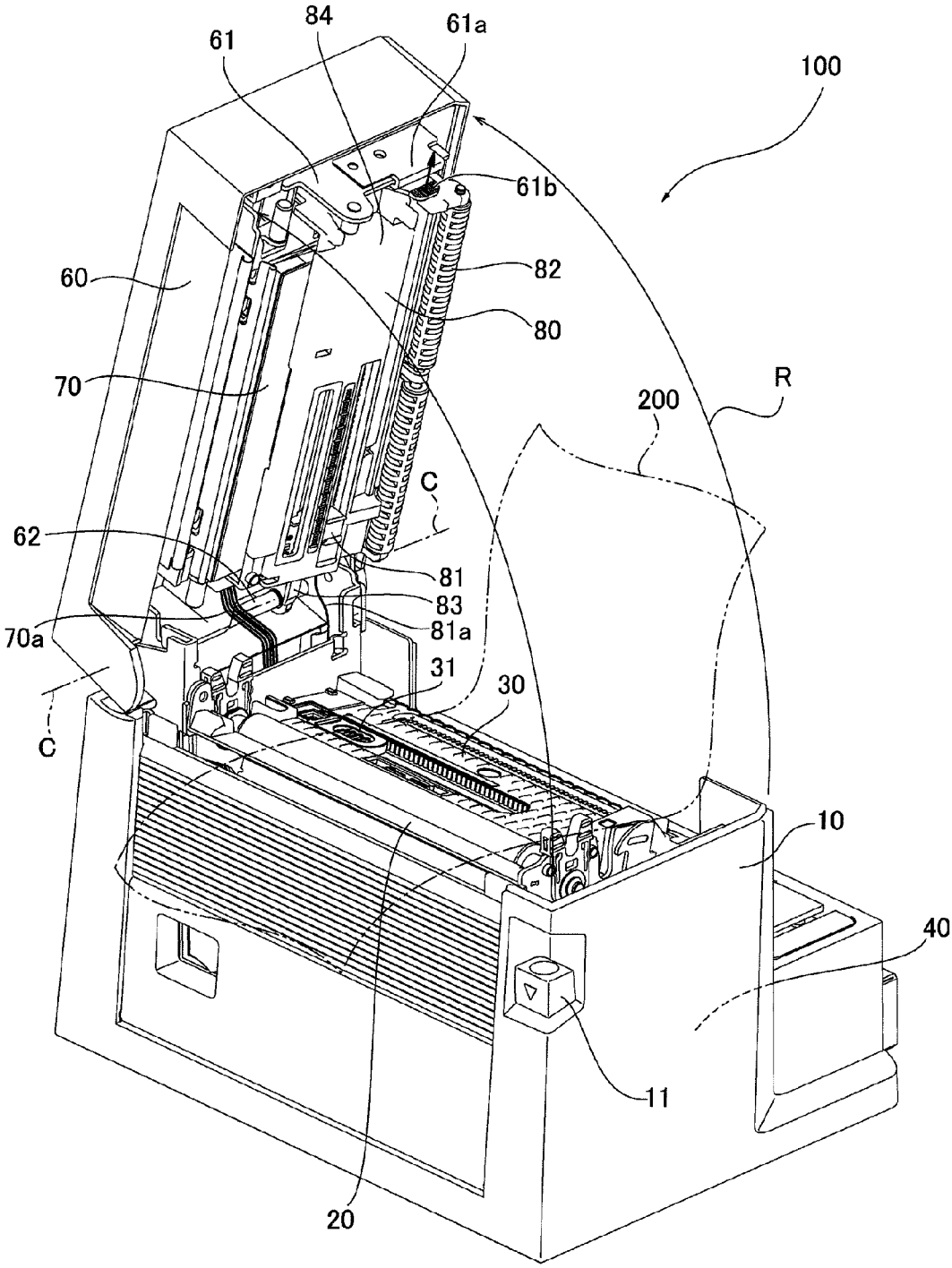
FIG. 2 is a view illustrating the thermal printer illustrated in FIG. 1 with an opened cover.

The unlocked cover 60 rotates in the counterclockwise direction R about a rotation central axis C as illustrated in FIG. 2 relative to the main body 10, so as to open laterally.

With the cover 60 opened as illustrated in FIG. 2, paper 200 provided between the main body 10 and the cover 60 can be replaced, and components provided inside the main body 10 and the cover 60 can be maintained, such as checking, replacing, or the like.

The main body 10 includes a platen roller 20, a guide plate 30 which guides a lower surface side of the paper 200 and a controller 40 which electrically controls the operation of the thermal printer 100. The guide plate 30 includes a refractive optical sensor 31 which optically detects a standard position mark or the like, formed on the back side of the paper 200 passing over the guide plate 30.

The detection results from the refractive optical sensor 31 are input to the controller 40, and the controller 40 controls the operations of the platen roller 20 and the after-described thermal head 70 based on the detection results or the like input from the refractive optical sensor 31 and an after-described transmissive optical sensor 81.

The refractive optical sensor 31 and the transmissive optical sensor 81 are movably provided in arbitrary positions in the width direction of the paper 200. By moving the positions of the respective optical sensors 31, 81, the optical sensors can be used for various types of paper having a different width or a different forming position of a standard position mark or the like.

On the other hand, the cover 60 includes the thermal head 70, which carries out thermal printing on the paper 200 and a head cover 80.

The head cover 80 is formed into a plate-like member by resin, and covers a part of the thermal head 70 (for example, a part having circuits, wires or the like). The head cover 80 includes a guide roller 82, which guides the paper 200 while having contact with the top surface of the paper 200 in a state in which the cover 60 is locked to the main body 10 (that is, the cover 60 is closed), and the transmissive optical sensor 81 (paper detector. The transmissive optical sensor 81 faces the refractive optical sensor 31 and detects, for example, a cutout for cutting the paper 200 which can not be detected by the reflective optical sensor 31, and detects the presence or absence of the paper 200 by receiving light (transmissive light via the paper 200) from a light source provided in the refractive optical sensor 31.

The detection results of the transmissive optical sensor 81 are input to the controller 40 as described above.

Although the thermal head 70 is secured to a metal frame 61 of the cover 60 with a screw, the thermal head 70 can be removed from the metal frame 61 by removing the screw with a tool. Thus, maintenance due to age deterioration, or the like, can be carried out.

The securing of the thermal head 70 is not limited to the above-described screw, however. It is also possible to provide a structure in which the thermal head 70 can be removed with the fingers without using a tool.

In this case, since a part of the thermal head 70 is covered by the head cover 80, it is necessary to keep the head cover 80 away from the thermal head 70 before removing the thermal head 70, so as to maintain a space required for removing the thermal head 70.

For this reason, it is desired for the head cover 80 to be secured to the thermal head 70 such that it can be easily removed from the thermal head 70 with a relatively simple operation without using a tool.

The head cover 80 of the thermal printer 100 includes one end (a first end) 83 and another end (a second end) 84 in the longitudinal direction. The first end 83 of the head cover 80 is rotatably supported by an axial-rod 62 provided coaxially with the rotation central axis C of the cover 60 relative to the main body 10. The second end 84 of the head cover 80 includes two square holes 84*a*, 84*b* (refer to FIGS. 3, 4). The two square holes 84*a*, 84*b* engage with the (not-shown) two projections of the lock member 61*a* secured to the metal frame 61, respectively, so that the head cover 80 is secured (detachably latched) to the cover 60.

The state in which the head cover 80 is secured to the cover 60 is a state in which the head cover 80 covers a part of the thermal head 70, and this position of the head cover 80 is a secured position.

A hook 61*b* formed in the lock member 61*a* is elastically deformed if it is pulled in the arrow direction illustrated in FIG. 2 by fingers or the like. The projection displaced in the arrow direction with the elastically deformed hook 61*b* is removed from each square hole 84*a*, 84*b* of the head cover 80. The head cover 80 is thereby released from the secured position to be rotatable about the axial-rod 62 (about the rotation central axis C), and is moved in a direction that moves away from the thermal head 70 by the rotation in the illustrated clockwise direction −R and into an open position (see FIG. 3).

Since the first end 83 of the head cover 80 is supported by the axial-rod 62 both in the secured position and the rotatable state (open position), the head cover 80 is not physically separated from the printer main body (main body 10 and cover 60).

In addition, the axial-rod 62 can be disposed in the cover 60, or can be disposed in the main body 10.

Figure 4:
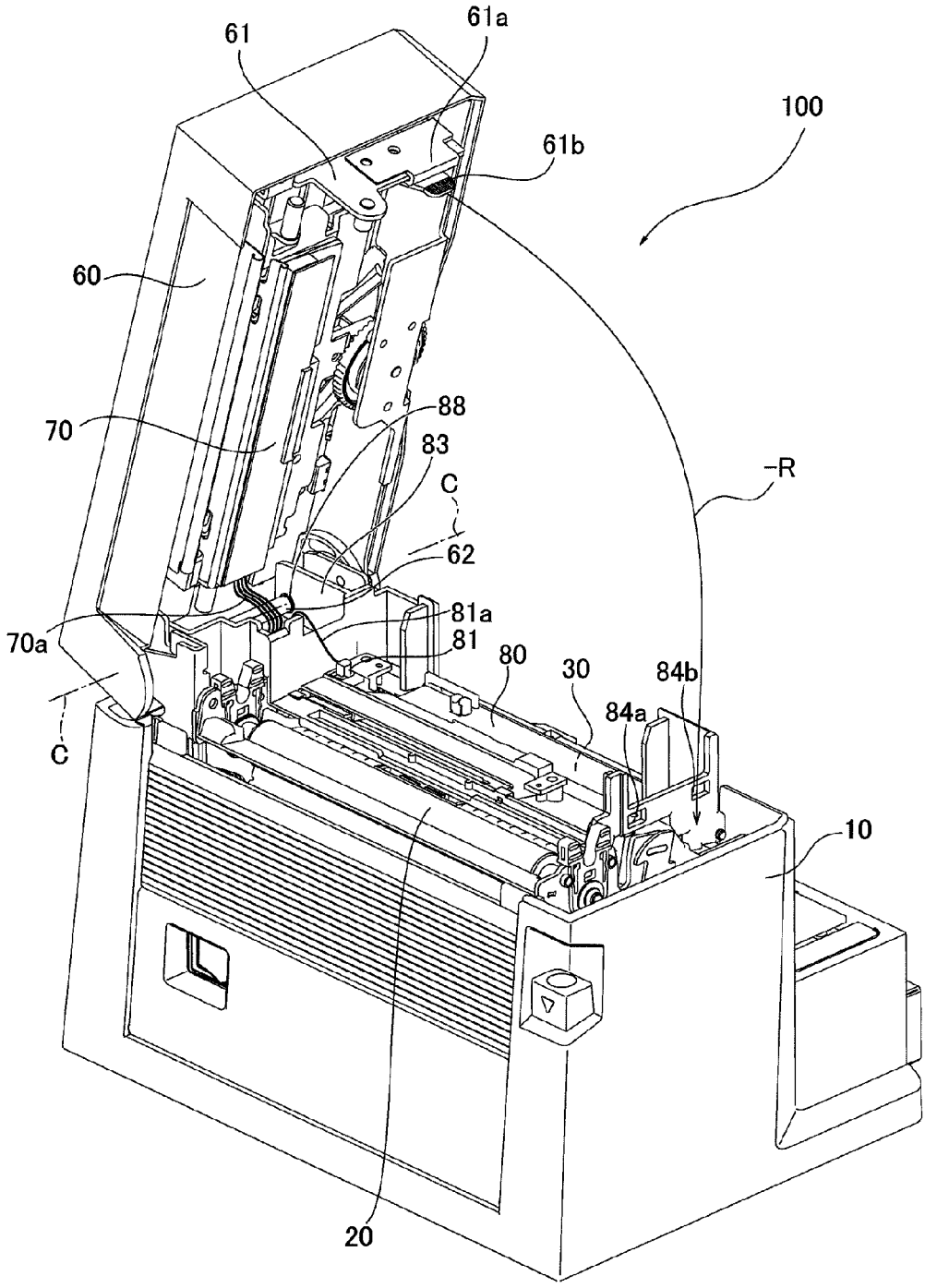
FIG. 4 is a view illustrating a state in which the head cover is further displaced from the state illustrated in FIG. 3 and a state in which the head cover is positioned by a guide plate.

Thus, the head cover 80 is further rotated such that the guide plate 30 of the main body 10 faces the head cover 80; namely, the guide plate 30 is overlapped (covered) by the head cover 80, as illustrated in FIG. 4. In this state, the head cover 80 is positioned furthest from the thermal head 70, so that the thermal head 70 can be removed from the metal frame 61.

The transmissive optical sensor 81 includes a lead wire 81*a* for sending a detection result to the controller 40. This lead wire 81*a* extends from the first end 83 side of the head cover 80 and is wired to pass through near the axial-rod 62, and the leading end of the portion which has passed through near the axial-rod 62 is pulled inside the main body 10 and is connected to the controller 40.

Similarly, a lead wire 70*a* of the thermal head 70 extends from one end portion of the thermal head 70 (the end portion closer to the first end 83 of the head cover 80), and is wired to pass through near the axial-rod 62. The leading end of the portion which has passed through near the axial-rod 62 is pulled inside the main body 10, and is connected to the controller 40.

Figure 5:
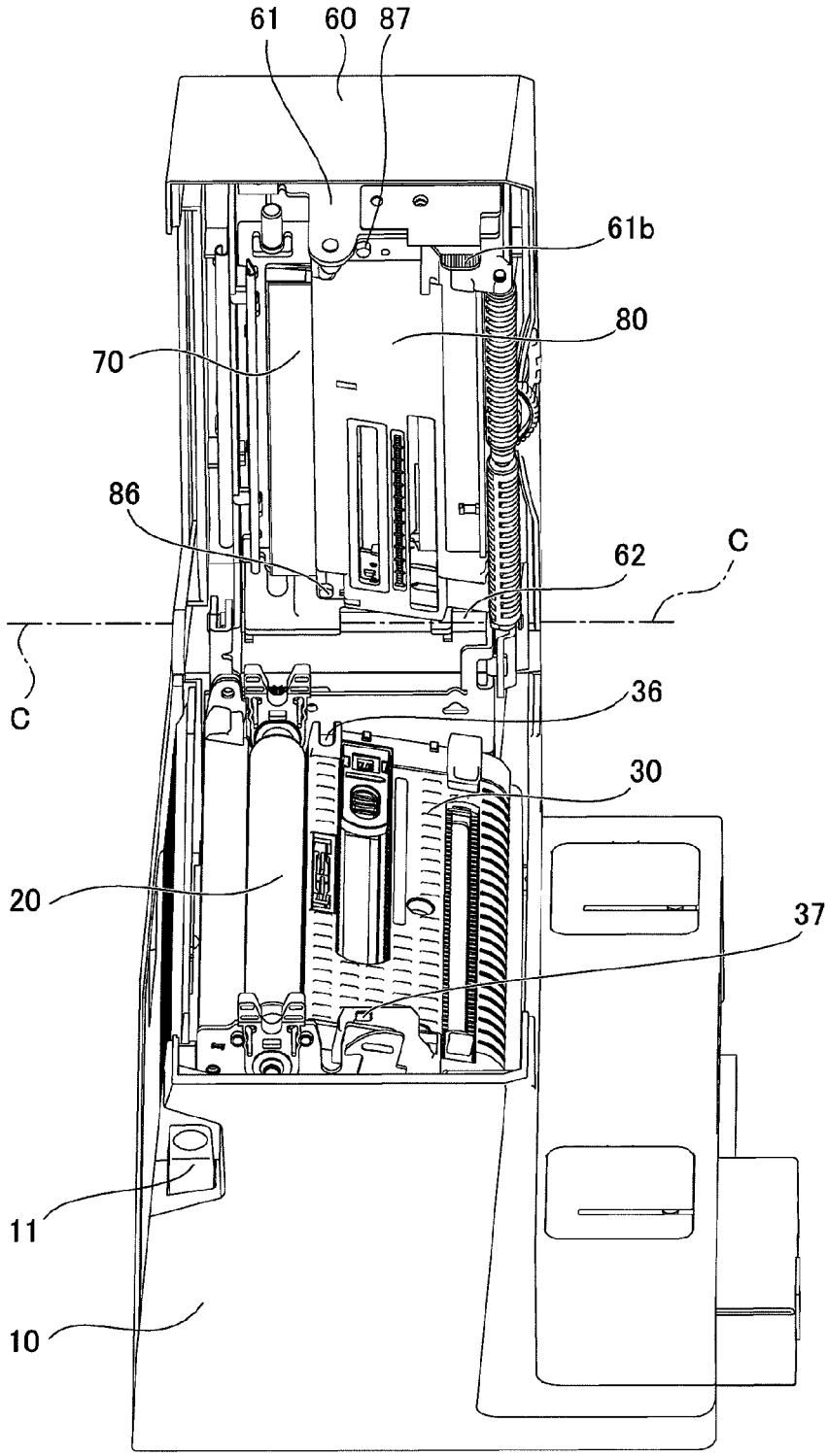
FIG. 5 is a view illustrating a state corresponding to the state in FIG. 2 as seen obliquely downward from the other end side of the head cover.

In addition, as illustrated in FIG. 5, showing a state which is the same as that in FIG. 2, as seen obliquely downward from the second end 84 side, the head cover 80 includes positioning projections 86, 87 provided in positions slightly different from each other in the front-back direction (corresponding to the traveling direction of the paper 200), which are positions similar to each other in both end portions of the longitudinal direction (corresponding to the width direction of the paper 200). On the other hand, the guide plate 30 of the main body 10 includes portions facing the positioning projections 86, 87 of the head cover 80, and the portions are in the form of positioning holes 36, 37 that the positioning projections 86, 87 fit into.

Thus, if the head cover 80 is rotated in the clockwise direction −R to the state illustrated in FIG. 4 in which the head cover 80 is positioned furthest from the thermal head 70, the positioning projections 86, 87 of the head cover 80 fit into the positioning holes 36, 37 of the guide plate 30, respectively. Thus, the position of the head cover 80 with respect to the guide plate 30 in the front-back direction and the width direction of the paper 200 is restrained, so that the head cover 80 is positioned.

The bearing of the head cover 80, which receives the axial-rod 62, is a hole 88 as illustrated in FIG. 4. The diameter of the hole 88 of the head cover 80 through which the axial-rod 62 is inserted is formed relatively larger than the outer diameter of the axial-rod 62, and the axial-rod 62 loosely engages with the hole 88 with an allowance.

Figure 3:
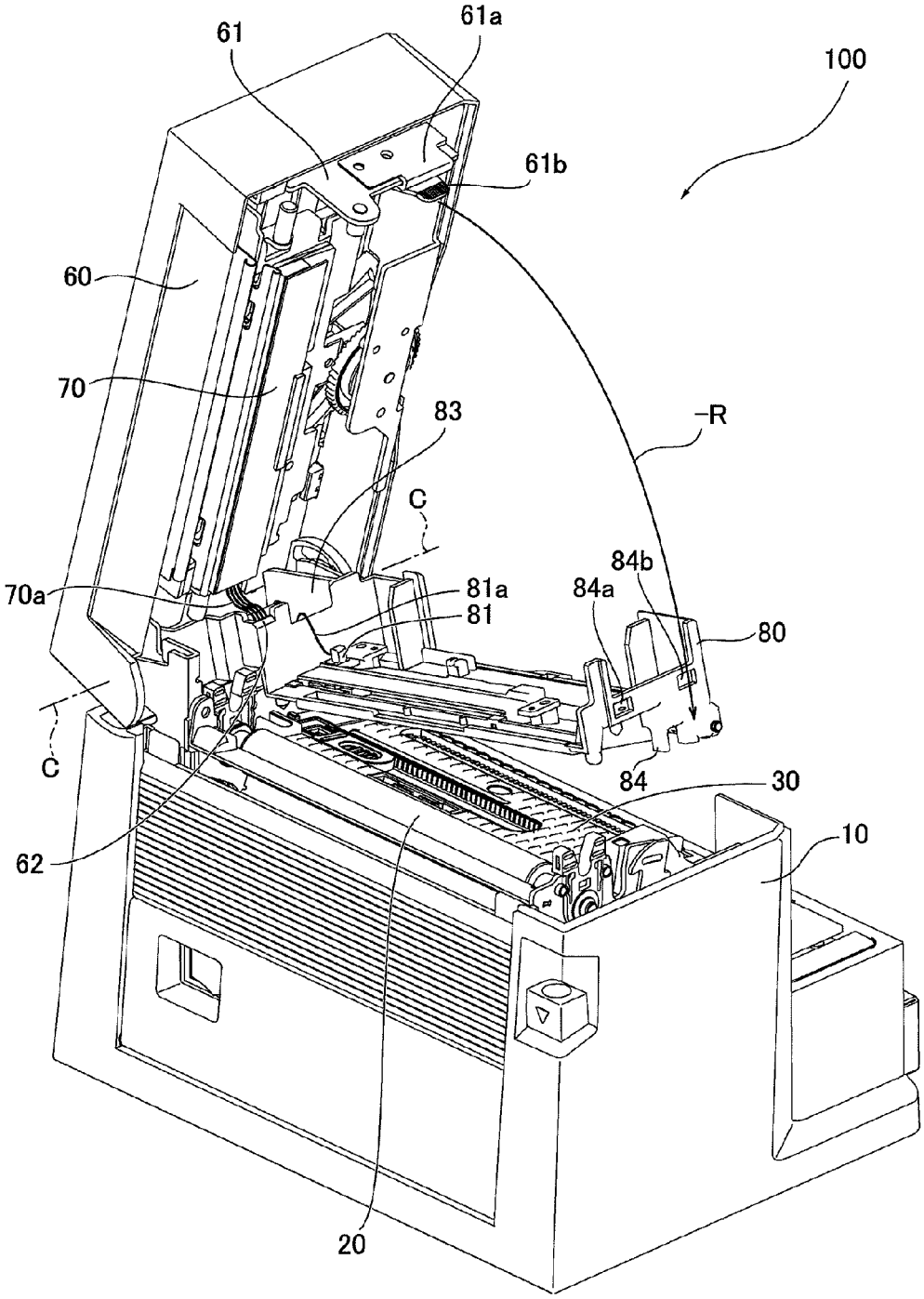
FIG. 3 is a view illustrating a state in which a head cover is displaced from the state illustrated in FIG. 2.

Therefore, as illustrated in FIG. 3, in a state before the positioning projections 86, 87 of the head cover 80 engage with the positioning holes 36, 37 of the guide plate 30, the rotating head cover 80 slightly slips with respect to the printer main body (main body 10 and cover 60).

However, in the state in which the head cover 80 faces the guide plate 30 as illustrated in FIG. 4, the positioning projections 86, 87 of the head cover 80 fit into the positioning holes 36, 37 of the guide plate 30, so that the head cover 80 is positioned relative to the guide plate 30 both in the front-back direction and the width direction of the paper 200. Thus, the slipping of the head cover 80 with respect to the printer main body is prevented.

In addition, the state illustrated in FIG. 4 (i.e., the state in which the head cover 80 is moved from the secured position which covers the thermal head 70, and is located by the engagement with the guide plate 30) is a temporal state for replacing the thermal head 70.

More specifically, from the state illustrated in FIG. 4, the cover 60 is rotated in the clockwise direction −R, and the cover 60 comes close to the head cover 80 overlapped with the guide plate 30 from the cover 60 side. After that, the hook 61*b* of the lock member 61*a* of the cover 60 is brought into contact with the head cover 80 to be elastically deformed, so that the projections of the lock member 61*a* engage with the square holes 84*a*, 84*b* of the head cover 80. In a normal situation, from the state illustrated in FIG. 4, the head cover 80 is rotated in the counterclockwise direction R, and comes close to the cover 60 from the head cover 80 side. After that, the head cover 80 is brought into contact with the hook 61*b* of the lock member 61*a* of the cover 60, so that the lock member 61*a* is elastically deformed. The projections of the lock member 61*a* thereby engage with the square holes 84*a*, 84*b* of the head cover 80, so that the head cover 80 is secured to the cover 60, and the cover 60 to which the head cover 80 is secured is closed by rotating in the clockwise direction −R. The lock mechanism connected to the opening-closing button 11 is thereby operated, and thus, the cover 60 is secured to the main body 10.

The state in which the cover 60 is secured to the main body 10, as illustrated in FIG. 1, is a usage state of the thermal printer 100. In this case, the positioning projections 86, 87 of the head cover 80 fit into the positioning holes 36, 37 of the guide plate 30, so that the head cover 80 is positioned relative to the guide plate 30 both in the front-back direction and the width direction of the paper 200.

According to the thermal printer 100 of the present embodiment, since the head cover 80 can be moved in the direction (clockwise direction −R) which moves away from the thermal head 70 and from the secured position (in which the head cover 80 is secured to cover the thermal head 70 in a state in which a part of the head cover 80 is supported by the printer main body), the thermal head 70 can be easily replaced by separating the head cover 80 from the thermal head 70.

Moreover, the head cover 80 is supported by the printer main body even if it is moved away from the thermal head 70. Therefore, it is never completely separated from the printer main body. Therefore, problems such as the misattachment of the head cover 80 or the loss of the head cover 80, which may occur if the head cover 80 is completely separated from the printer main body, can be prevented.

Since the head cover 80 is not completely separated from the printer main body, the holding of the lead wire 81*a* due to reassembling when the head cover 80 is completely separated from the printer main body can be prevented, and it is not necessary to pay particular attention to such holding of the lead wire 81*a*.

According to the thermal printer 100 of the present embodiment, the axial-rod 62 is provided in the printer main body, the hole 88, such as a bearing with the axial-rod 62 as the rotation central axis C, is formed in the head cover 80, and the head cover 80 is supported by the printer main body with the engagement (rotatable support) between the axial-rod 62 and the hole 88. Therefore, the head cover 80 is separated from the thermal head 70 by the rotational displacement with the axial-rod 62 to form the rotation central axis C. Accordingly, in the rotational displacement, different from linear displacement, a displacement distance differs in each portion, and the displacement distance is reduced as the portion comes close to the rotation central axis C.

Consequently, the lead wire 81*a* of the transmissive optical sensor 81 attached to the head cover 80 can be passed through the main body 10 (controller 40) from the one end 83 which is the side closer to the rotation central axis C, and the displacement of the lead wire 81*a*, due to the opening and closing (rotation) of the head cover 80, can be reduced. Thus, the durability of the lead wire 81*a* can be improved.

According to the thermal printer 100 of the present embodiment, the lead wire 81*a* is wired to pass through near the axial-rod 62, so that the relative positional relationship between the head cover 80 and the lead wire 81*a* hardly changes by the rotation of the head cover 80. Therefore, the wiring condition can be stabilized and the durability of the lead wire 81*a* can be further improved.

By cording the lead wire 81*a* of the transmissive optical sensor 81 and the lead wires 70*a* of the thermal head 70, the rigidity of the corded lead wires 81*a*, 71*a* is improved, so that even if an excessive tension acts on the lead wires, the lead wires 81*a*, 70*a* are unlikely to be cut.

According to the thermal printer 100 of the present embodiment, the rotation central axis C of the head cover 80 is disposed coaxially with the rotation central axis C of the cover 60. Even if the closing operation which rotates in the clockwise direction −R such that the cover 60 engages with the main body 10 is conducted by mistake in a state in which the head cover 80 is separated from the thermal head 70 as illustrated in FIG. 4, for example, the cover 60 is rotated according to the orbit which is similar to that of the head cover 80, and is overlapped with the head cover 80, and the projections formed in the lock member 61*a* of the cover 60 engage with the square holes 84*a*, 84*b* formed in the head cover 80, so that the head cover 80 can be secured normally to the cover 60.

According to the thermal printer of the present embodiment, the engagement of the axial-rod 62 and the hole 88 as a bearing is a loose engagement having an allowance, the head cover 80 faces the guide plate 30 in a state in which the cover 60 is secured to the main body 10, and the positioning portion (positioning projections 86, 87 and positioning holes 36, 37), which controls the position of the head cover 80 to the guide plate 30, is formed in the guide plate 30 and the head cover 80. Therefore, it becomes unnecessary to strictly manage the measurement difference between the axial-rod 62 and the hole 88; thus, the manufacturing costs can be reduced.

According to the thermal printer of the present embodiment, since the head cover is moved from a position which covers the thermal head to a position away from the thermal head, the thermal head can be easily replaced without trouble. Moreover, since a part of the head cover is supported by the printer main body, the head cover is held in the printer main body when the head cover is moved, so that the head cover is not completely separated from the printer main body, preventing trouble such as loss of components.

According to the thermal printer of the present embodiment, a problem that occurs in the head cover when replacing the thermal head can be prevented.

Although the embodiment of the present invention has been described above, the present invention is not limited thereto. It should be appreciated that variations may be made in the embodiment described by persons skilled in the art without departing from the scope of the present invention.

What is claimed is:

1. A thermal printer comprising:

a printer main body;

a thermal head;

a head cover configured to be movable from a secured position, in which said head cover is secured so as to cover at least a part of said thermal head, in a direction away from said thermal head while at least a part of said head cover is supported by said printer main body;

an axial-rod in one of said head cover and said printer main body; and a bearing rotatably supporting said axial-rod so that said axial-rod forms a rotation central axis in the other of said head cover and said printer main body, said head cover being supported by said printer main body with engagement between said axial-rod and said bearing;

wherein said head cover includes a paper detector configured to detect the presence or absence of paper or a standard position of the paper; and wherein said paper detector includes a lead wire arranged to pass through near said axial-rod.

2. The thermal printer of claim 1, wherein said printer main body includes:

a main body having a platen roller; and a cover accommodating said thermal head and said head cover, said cover being configured to be rotatable about a predetermined axis relative to said main body, an axis of rotation of said head cover being coaxial with an axis of rotation of said cover.

3. The thermal printer of claim 2, wherein:

said main body includes a guide plate configured to guide the paper;

said axial-rod and said bearing are loosely engaged so as to have an allowance; and said head cover faces said guide plate such that said cover is secured to said main body, and a positioning portion for controlling a position of said head cover relative to said guide plate is formed in said guide plate and said head cover.

4. The thermal printer of claim 1, wherein said printer main body includes:

a main body having a platen roller; and a cover pivotally connected to said main body;

wherein said head cover has a longitudinal axis with a first end pivotally connected to at least one of said cover and said main body, and with a second end configured to be detachably latched to said cover, said second end being opposite said first end, said head cover being pivotally movable between a secured position, in which said second end is detachably latched to said cover such that said head cover covers at least a part of said thermal head, and an open position, in which said second end is unlatched from said cover and is located away from said thermal head.

5. The thermal printer of claim 4, wherein one of said cover and said main body includes an axial rod, said first end of said head cover being pivotally mounted to said axial rod so as to be pivotally movable about said axial rod between said secured position and said open position.

6. The thermal printer of claim 5, wherein said cover is pivotally connected to said main body so as to pivot with respect to said main body about an axis of rotation, said axis of rotation being coaxial with said axial rod.

7. The thermal printer of claim 4, wherein said head cover is arranged so that said longitudinal axis of said head cover is substantially perpendicular to a direction of travel of paper through said thermal printer.

8. The thermal printer of claim 4, wherein said first end of said head cover is supported by said main body.

9. A thermal printer comprising:

a printer main body;

a thermal head;

a head cover configured to be movable from a secured position, in which said head cover is secured so as to cover at least a part of said thermal head, in a direction away from said thermal head while at least a part of said head cover is supported by said printer main body;

an axial-rod in one of said head cover and said printer main body; and a bearing rotatably supporting said axial-rod so that said axial-rod forms a rotation central axis in the other of said head cover and said printer main body, said head cover being supported by said printer main body with engagement between said axial-rod and said bearing;

wherein said printer main body includes:

a main body having a platen roller; and a cover accommodating said thermal head and said head cover, said cover being configured to be rotatable about a predetermined axis relative to said main body, an axis of rotation of said head cover being coaxial with an axis of rotation of said cover.

10. The thermal printer of claim 9, wherein:

said main body includes a guide plate configured to guide the paper;

said axial-rod and said bearing are loosely engaged so as to having an allowance; and said head cover faces said guide plate such that said cover is secured to said main body, and a positioning portion for controlling a position of said head cover relative to said guide plate is formed in said guide plate and said head cover.

11. The thermal printer of claim 9, wherein said head cover is pivotally connected to at least one of said cover and said main body so as to pivot about said axis of rotation of said head cover between a secured position, in which said head cover at least partially covers said thermal head, and an open position, in which said thermal head is uncovered by said head cover.

12. The thermal printer of claim 11, wherein one of said cover and said main body includes an axial rod, said head cover being pivotally mounted to said axial rod so as to be pivotally movable about said axial rod between said secured position and said open position.

13. The thermal printer of claim 11, wherein said head cover is arranged so that a longitudinal axis of said head cover is substantially perpendicular to a direction of travel of paper through said thermal printer.

* * * * *